US008720709B2

(12) United States Patent
Willim

(10) Patent No.: US 8,720,709 B2
(45) Date of Patent: May 13, 2014

(54) CRANE AND METHOD FOR ERECTING THE CRANE

(75) Inventor: Hans-Dieter Willim, Ulm-Unterweiler (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 391 days.

(21) Appl. No.: 13/103,521

(22) Filed: May 9, 2011

(65) Prior Publication Data

US 2011/0272375 A1 Nov. 10, 2011

(30) Foreign Application Priority Data

May 10, 2010 (DE) ..... 10 2010 020 016

(51) Int. Cl.
*B66C 23/42* (2006.01)

(52) U.S. Cl.
USPC ..... 212/296; 212/297

(58) Field of Classification Search
USPC ..... 254/296, 297, 201, 231, 237, 239, 240, 254/246, 262, 264
See application file for complete search history.

(56) References Cited

U.S. PATENT DOCUMENTS

| | | | | |
|---|---|---|---|---|
| 3,153,486 | A * | 10/1964 | Strnad | 414/564 |
| 3,477,522 | A * | 11/1969 | Templeton | 173/196 |
| 7,516,858 | B2 * | 4/2009 | Willim | 212/300 |
| 2002/0070187 | A1 * | 6/2002 | Willim | 212/299 |
| 2009/0134108 | A1 * | 5/2009 | Willim | 212/270 |
| 2010/0158654 | A1 | 6/2010 | Willim | |

FOREIGN PATENT DOCUMENTS

| | | | |
|---|---|---|---|
| DE | 10 2007 056 289 | A1 | 4/2009 |
| DE | 10 2007 051 539 | A1 | 5/2009 |
| DE | 10 2008 035 583 | A1 | 2/2010 |

OTHER PUBLICATIONS

ISA German Patent and Trademark Office, Search Report of DE 10 2010 020 016.6-22, Apr. 27, 2011, 2 pages.

* cited by examiner

*Primary Examiner* — Emmanuel M Marcelo
(74) *Attorney, Agent, or Firm* — Alleman Hall McCoy Russell & Tuttle LLP

(57) ABSTRACT

A method for telescoping a main boom includes guying the erected main boom during the telescoping operation, the main boom consisting of a telescopic boom which is guyed via a spatial boom guying. Further, a crane may include a telescopable main boom, a spatial guying and a crane controller, wherein the crane controller determines the necessary guy dimension of the spatial guying in dependence on the current main boom length during the telescoping operation.

20 Claims, 4 Drawing Sheets from L calculation of $L_S + \Delta_{LS\ variable}$ (= f(L))

CRANE AND METHOD FOR ERECTING THE CRANE

CROSS REFERENCE TO RELATED APPLICATION

This application claims priority to German Patent Application No. 10 2010 020 016.6, entitled "Crane and Method for Erecting the Crane", filed May 10, 2010, which is hereby incorporated by reference in its entirety for all purposes.

TECHNICAL FIELD

The present disclosure relates to a method for telescoping a main boom that is guyed via a spatial boom guying. Furthermore, the present disclosure relates to a crane with a telescopable main boom, a spatial guying and a crane controller. The present disclosure is suitable in particular for long boom systems with boom extensions, adapters and/or fly jibs and also eccentrics in accordance with DE 20 2004 017 771 U1.

BACKGROUND AND SUMMARY

To increase the lifting capacity of a crane it is already known to mount a guy on or behind the boom. For example in cranes with telescopic boom a substantial increase in lifting capacity is achieved by a spatial guying.

For a better understanding, an essential effect of a spatial guying, for example a Y-guy, will be explained here. FIG. 2 schematically shows a guyed telescopic boom 1 which can be luffed up about a horizontal luffing axis 200. The spatial guying substantially consists of the guy stranding 13 and the guy supports 16 attached to the boom articulation piece in a V-shaped manner.

FIGS. 2*a*, 2*b* show a schematic representation of a telescopic boom 1 guyed by means of a Y-guy in a rear view and in a side view. Both representations show no deviation of the boom 1 from the ideal luffing plane, so that the resulting moment about the luffing axis virtually decreases to zero. As a result, the entire load moment caused by the load 202 is received by the luffing cylinder 201.

In FIGS. 2*c* and 2*d*, on the other hand, a real load case is represented. The force F of the load 202 acts on the tip of the telescopic boom 1 and deflects the same. In addition, there are further disturbing quantities acting on the boom 1, such as the wind force, which deflect the boom 1 from the ideal luffing plane. The boom tip of the telescopic boom 1 hence moves out of the ideal luffing plane by the amount a, whereby the attached load 202 or the load force F acts with the lever arm a. The resulting moment M furthermore effects an increasing deflection of the telescopic boom 1 from the ideal luffing plane, which in turn results in an increase of the moment caused.

If long boom systems with spatial guying are to be erected, the unguyed telescopic boom can already reach its load limits during erection. The entire weight of the attached boom elements acts on the boom like a load to be lifted, which leads to the aforementioned problems. Especially in particularly long boom systems, the corresponding forces act with an even greater lever arm.

To solve the aforementioned problems, some considerations are already known from the prior art, which allow the erection of such long boom systems despite said problems.

From DE 10 2007 056 289 A1 there is known a method for erecting a main boom at least consisting of a telescopic boom with a fly jib and a spatial boom guying. Here, the telescopable main boom is brought into a steep position and subsequently telescoped out, wherein the main boom is guyed by the spatial guying only upon completion of the telescoping operation.

Another method for erecting a crane boom is known from DE 10 2007 051 539 A1. In this method, too, the spatial guying only is tensioned after the telescopable main boom has been telescoped out completely.

Accordingly, none of these solutions offers the possibility to telescope the main boom and at the same time hold it in the ideal line via the spatial guying, in order to protect the boom against occurring disturbing quantities.

It now is the object of the present disclosure to provide a method and an apparatus which should protect the main boom of a crane against too great deviations from the ideal line during the telescoping operation.

This object is solved by a method wherein the erected main boom is limited in its lateral deflection, in particular guyed, during the telescoping operation by the spatial guying. Accordingly, there is provided a method for telescoping a main boom consisting of a telescopic boom, which is guyed via a spatial boom guying. In accordance with the present disclosure, the erected main boom is guyed by the spatial guying during the telescoping operation. In accordance with the present disclosure, the main task of the spatial guying, i.e. minimizing the deflections of the main boom from the ideal luffing plane, also is applied to the telescoping operation of the telescopable main boom.

In the retracted condition, the main boom is steeply erected, with the guy being tensioned before or after the erecting operation. Erecting the telescopable main boom in the retracted condition reduces the moment caused by the respective weight forces, which acts on the main boom. Preferably, the boom is brought into a very steep position. In this position, the bearing forces transmitted by each inner telescopic section to the surrounding telescopic section are minimal. This effect is particularly desirable, since these bearing forces considerably impede the movement between the telescopic sections. Due to the steep position of the main boom, the force to be applied by the telescoping drive is increased, in order to counteract the increasing weight force of the part of the boom system to be pushed out, but this disadvantage is negligible as compared to the decreasing bearing forces. To protect the boom against disturbing forces acting on the same, said boom also is guyed for the first time during the telescoping operation by the spatial guying in accordance with the present disclosure.

To be able to utilize the effect of the spatial guying while pushing out the individual telescopic sections, the spatial guying is varied during the telescoping operation with respect to the geometrical dimension synchronous to the increasing boom length. Advantageously, the main boom is guyed via the guy stranding of the spatial guying, wherein the length of the guy stranding is adapted to the main boom length during the telescoping operation. Accordingly, the changes in length of telescopic boom and guy stranding are actuated synchronously.

The entire guying force applied by the spatial guying preferably is generated by the guy winches alone provided for this purpose. This means that both the telescoping drive and the winch drive at least must operate under parts of the guying force. The actuation of the two drives is performed by a crane controller. The same ensures the necessary synchronous operation of the two drives, in that the control commands are adjusted to each other and adapted, if necessary.

It is advantageous when the crane controller detects the current length of the telescopic boom during the telescoping operation and from this value determines the necessary geometrical dimension of the guying, in particular the length of the guy stranding. The current length data of the telescopic boom can be determined for example by a monitoring system and be transmitted to the crane controller. The crane controller then calculates the necessary current length of the guying from these detected measurement data. Preferably, the calculation of the necessary dimension of the guying is effected according to a predefined formula which is stored in the crane controller. Via this formula and possibly further known and/or stored geometry data of boom and guying, it always is ensured that the spatial guying bracing the main boom only introduces a very small, but still sufficient guying force into the telescopic boom. In this way, the additional load acting on the telescoping drive should be kept as small as possible.

For safety reasons it can be provided that the actual length of the guying, in particular the stranding length, likewise is monitored by the crane controller. For this purpose, existing monitoring systems can be used, which constantly check in particular the length of the used guy rope of the spatial guying and forward the detected measurement data to the crane controller. The crane controller compares the detected measurement data with the data for the respective length of the spatial guying, which are calculated in dependence on the current telescoping length of the main boom. Suitable countermeasures possibly can be taken in the case of deviations to maintain safety.

The possible deviation of the main boom increases with the length of the telescopic boom. This is due to the shorter distance of the bearing points of the telescopic sections in the extended condition and according to the theory of intersecting lines. Against this background it turns out to be particularly advantageous when the guying force provided by the spatial guying on the telescopable main boom is varied during the telescoping operation. Thus, for example at the beginning of the telescoping operation, the guying force introduced can be kept particularly low, in order to limit the resulting additional load acting on the telescoping drive. At the beginning, for example, when telescoping out, a slightly larger deviation from the ideal path, i.e. a deviation from the ideal luffing plane of the telescopic boom, can still be permitted. Only when the boom moves away from the ideal path in the luffing plane inadmissibly far, the guying force advantageously is increased. This effects that the boom is moved back into the admissible path. Preferably, the crane controller actuates the spatial guying such that the force introduced into the boom by the guying increases disproportionately with the deflection of the telescopic boom.

To detect the respective deviation of the main boom from the ideal path, monitoring systems possibly are used, which are suitable for the metrological determination of the deviation and forward these data to the controller. The crane controller evaluates the data received and adapts the applied guying force possibly by targeted actuation of the winch drive of the guying.

Furthermore, the present disclosure is directed to a crane with a telescopable main boom, a spatial guying, and a crane controller. The spatial guying preferably can be configured as a Y-guy, which in general includes two guy supports of at least one of the telescopic sections of the main boom, which are spread apart in a V-shaped manner, and at whose ends a guy stranding extends. In accordance with the present disclosure it is provided that the crane controller includes a processor and/or chip medium with instructions, which may be software instructions, for determining the necessary dimension of the spatial guying in dependence on the current main boom length during the telescoping operation. The crane boom is guyed by the spatial guying already before the telescoping operation. In accordance with the present disclosure, the effect of the spatial guying can also be utilized while pushing out the individual telescopic sections of the telescopable main boom. The geometrical dimension of the spatial guying is synchronously adapted to the varying length of the telescopic boom during the telescoping operation, for example based on feedback sensor information. Since the spatial guying generally extends along the length of the main boom, the length of a possibly present guy stranding consequently is adapted to the actual length of the main boom. Accordingly, the controller is suitable for determining the requirement amount of rope in dependence on the current boom length.

Advantageously, the crane controller possesses actuators for actuating the guy drive in dependence on the determined necessary guy dimension. Accordingly, the crane controller determines the necessary geometrical dimension of the spatial guying from the currently existing boom length during the telescoping operation and transmits the corresponding control commands to the drive for controlling the spatial guying, in order to generate the required guying force on the boom. Furthermore, the controller can also be suitable for actuating the telescopic boom drive.

Advantageously, one or more monitoring sensors or sensor systems are arranged on the crane for detecting the main boom length and/or other operating parameters. The same continuously detect the current position and/or length of the main boom during the telescoping operation. The detected measurement data in particular are transmitted to the crane controller via a bus system. Alternatively or in addition a wireless transmission system can be used. The monitoring systems can be configured as sensors which may be arranged on the individual telescopic sections of the telescopable main boom.

Furthermore, further monitoring systems can be provided, which provide for a detection of the guy dimension, in particular the length of the guy stranding. The monitoring systems can be configured as a corresponding sensor system, wherein the detected measurement data are transmitted to the crane controller via a bus system or via a wireless transmission system. The individual sensors of the used sensor system preferably are arranged directly on the guy stranding of the spatial guying or on at least one guy winch. The combination of sensor system and crane controller not only provides for achieving the desired nominal length, but in addition it can also be confirmed that the desired nominal length has been maintained accurately enough.

In a particularly preferred aspect of the present disclosure the spatial guying for the main boom of the crane provides two guy supports with one guy winch each, which are mounted on one of the telescopic sections. Proceeding from the respective guy winch, the guy stranding is guided along the main boom to the main boom tip and redirected by a deflection pulley arranged at the tip. In contrast to a known Y-guy, in which the guying is bolted in the working condition or tensioned via a tensioning cylinder, the guy winch of the spatial guying according to the present disclosure applies the entire guying force.

For driving at least one guy winch, a plurality of winch drives preferably are provided per guy winch. The individual winch drives can be designed positively, in the manner of a known slewing gear drive.

To keep the guy stranding tensioned, a mechanical lock may be provided in at least one guy winch. What is possible is the design of a mechanical locking by a locking pawl, for example. Furthermore, a brake system can also be integrated in the winch drive. Alternative braking systems are of course conceivable.

To keep the rope diameter of the guy rope and hence the dimension of the guy winches as well as the deflection pulleys as small as possible, each guying is of the four-stranded type, whereby the load acting on rope and guy winch can be reduced.

Furthermore, the present disclosure relates to a crane controller for a crane which in particular is designed according to one of the aforementioned features, comprising a crane control software for carrying out the method of the present disclosure according to one of the aforementioned features.

Further advantages, details and features will be explained in detail with reference to an embodiment illustrated in the drawings.

The principle of a spatial guying has already been explained above in detail with reference to FIGS. 2*a* to 2*d*, so that a repeated discussion will be omitted at this point.

Figure 1:
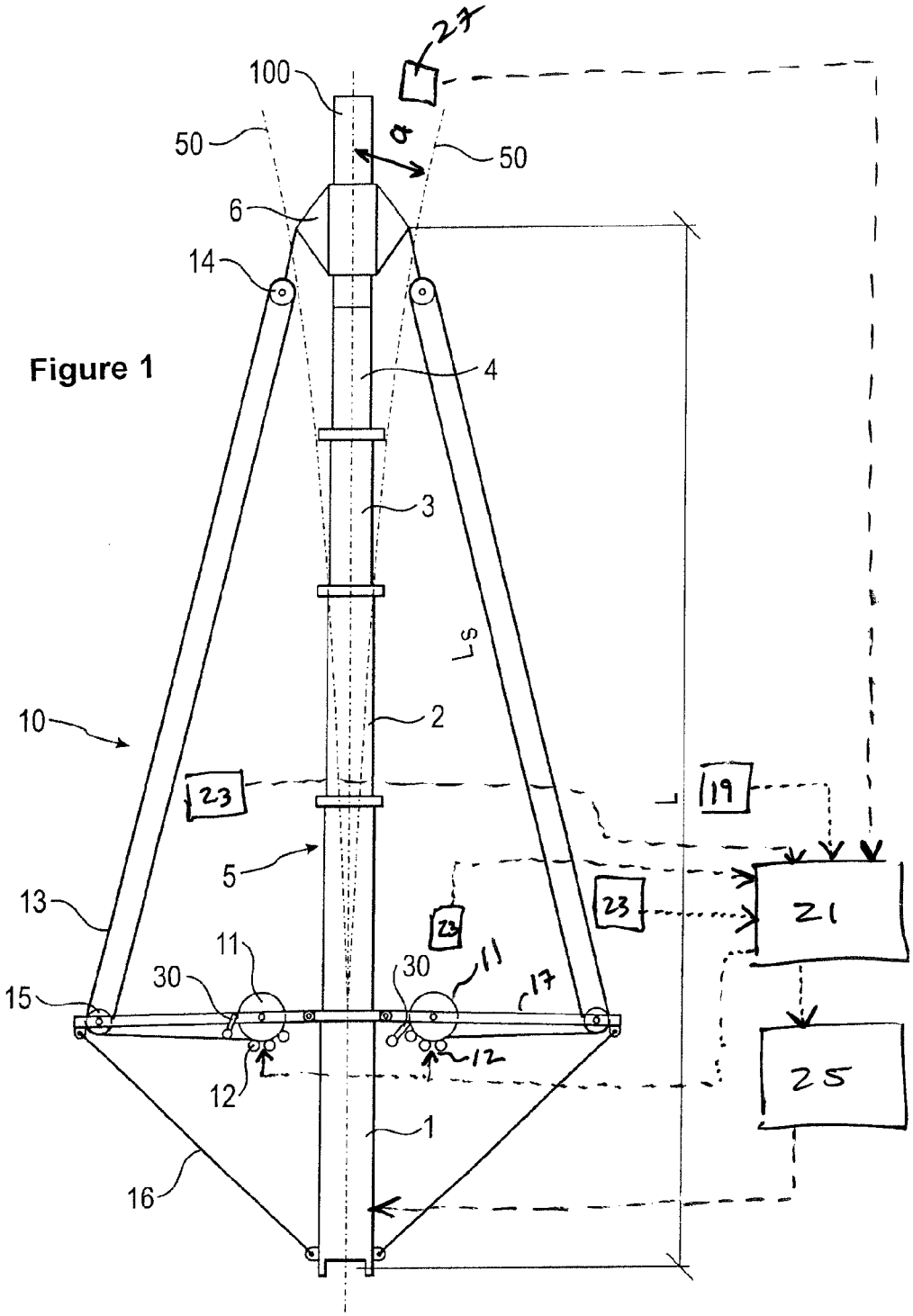
FIG. 1 shows the telescopic boom of a crane according to the present disclosure.
Figure 2:
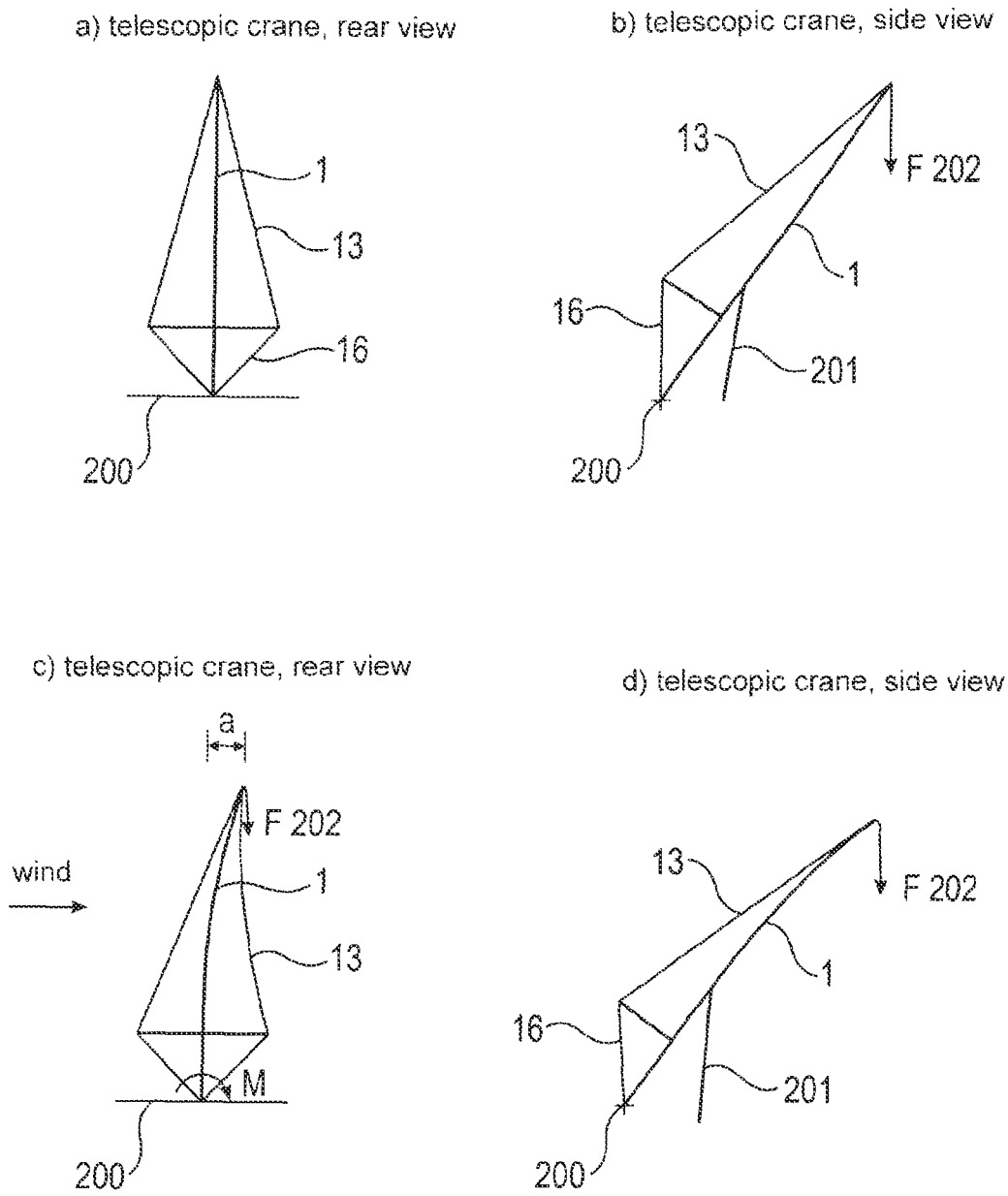
FIG. 2 shows a plurality of representations of the principle of a spatial guying.

With reference to FIG. 1, the basic structure of the telescopic boom 5 according to the present disclosure and its mode of operation can be explained.

For example, FIG. 1 shows a telescopic boom 5 with an articulation section 1 and a plurality of telescopable telescopic sections 2, 3, 4. At the boom tip of the telescopic boom 5 further boom extensions 100, such as intermediate pieces or fly jibs, can be provided. Furthermore, an eccentric 6 can be mounted between boom extension 100 and telescopic boom 5, as it is known from DE 20 2004 017 771 U1. In this connection, reference is fully made to said document at this point.

The two broken lines 50 represent the possible lateral deviation of the telescopic boom 5 with respect to the ideal luffing plane. It can be taken from FIG. 1 that this deviation 50 increases with the length L of the telescopic boom 5. The deviation in dependence on the two parameters can be explained by the shorter distance of the bearing points of the telescopic sections 1, 2, 3, 4 to each other in the condition pushed out and by the mathematical formula of the intersecting lines.

In accordance with the present disclosure, the telescopic boom 5 includes a spatial guying 10 in the form of a Y-guy which allows guying of the main boom 5 during the telescoping operation. By means of the Y-guy 10, deviations of the main boom 5 during the telescoping operation should largely be minimized. The guying 10 substantially consists of two guy supports 17 with one guy winch 11 each arranged thereon, which in the present case are articulated to the articulation section 1 in a V-shaped manner. Proceeding from the guy winches 11, the guy stranding 13 is guided over the deflection pulley 15 at the end of the guy support 17 along the main boom 5 to the boom tip. At the boom tip further deflection pulleys 14 are arranged, which redirect the guy stranding 13 back to the guy support 17. Furthermore, the two guy rods 16 of defined, fixed, length are provided, which connect the foot of the articulation section 1 with the outer end of the guy supports 17.

In the region of the guy winches 11, which have teeth on their outer circumference, engageable locking pawls 30 are arranged, which after correspondingly snapping into place between the teeth lead to a positive locking of the winches 11.

As in contrast to the known Y-guy, in which the guying is bolted in the working condition or tensioned via a tensioning cylinder, the guy winches 11 apply the entire guying force, a plurality of winch drives 12 are provided per winch 11. In addition to the mechanical locking by means of the locking pawl 30, integrated brakes are provided in the winch drives 12 as well as possibly further braking means. In the region of the main boom one or more sensors 19 are provided, which detect the current length L of the telescopic boom 5 and forward the same automatically, for example via a bus system or a wireless transmission system (dashed lines), to the crane controller 21.

In addition, in particular in the region of the guy winch 11 and the guy stranding 13, corresponding sensor systems 23 are mounted, which measure the actual rope length of the guy stranding 13. These measurement data also are forwarded to the crane controller 21 via the bus system or by a wireless transmission system. These or another sensor or sensor system 27 may also monitor the deviation "a" and transmit such information to the controller. Alternatively, the deviation "a" may be estimated based on the measured boom length and/or respective lengths (e.g., differential in lengths) of the guy strandings.

Each guy is of the four-stranded type, whereby the required rope diameter of the guy stranding 13 is kept at a minimum. The smaller the required rope diameter, the smaller can be the geometrical dimension of the deflection pulleys 14, 15 and of the guy winches 11.

Figure 4:
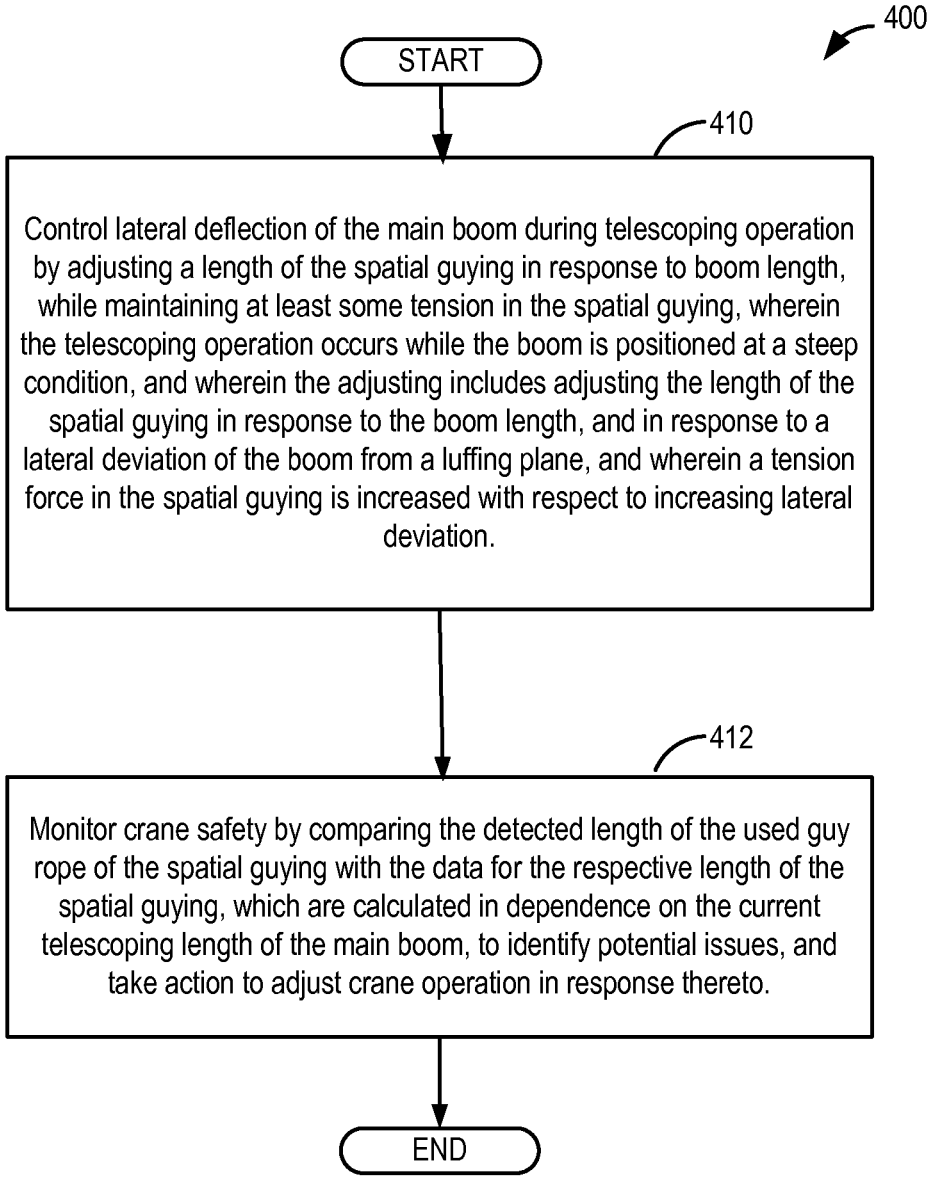
FIG. 4 shows a method 400 carried out by the crane controller.

In the following, the method of the present disclosure for erecting the telescopic boom 5 will be explained again. See also 410 of FIG. 4.

In the retracted condition, the boom system 5 is erected very steeply. Erecting in the retracted condition reduces the moment caused by the respective weight forces, which acts on the main boom. For example, the moment caused is amplified by a mounted propeller manipulator, as it is known from DE 20 2008 016 578. In the now steeply oriented position of the telescopic boom 5 the bearing forces transmitted by each inner telescopic section 2, 3, 4 to the surrounding section 1, 2, 3 are smallest. Since these bearing forces in general considerably impede the movement between the telescopic sections 1, 2, 3, 4, erecting the telescopic boom 5 into a very steep position before commencement of the telescoping operation is found to be particularly advantageous. This advantageous effect is not significantly impaired either by the growing weight force of the part of the boom system to be pushed out in the steeply erected position of the main boom 5.

In the retracted condition, the telescopic boom 5 is already guyed by the Y-guy 10 in accordance with the present disclosure. The amount of rope of the stranding 13 unwound from the guy winches 11 is adapted to the length L of the telescopic boom 5 in the retracted condition by the controller. Guying the boom 5 selectively can be effected before or after bringing the boom 5 into a steep position.

When the individual telescopic sections 2, 3, 4 of the telescopic boom 5 now are extended one after the other by the telescoping drive, the boom length L is growing constantly. To ensure a constant and effective guying of the boom 5 during the telescoping operation, it is necessary to vary the length of the guy stranding 13 on telescoping synchronous to the boom length L. The corresponding actuation of the telescoping drive 25 and/or the guy winch drive 12 is effected by the crane controller of the crane. The telescoping drive 25 is coupled to the boom 5 and configured to extend and/or retract the telescoping boom.

Figure 3:
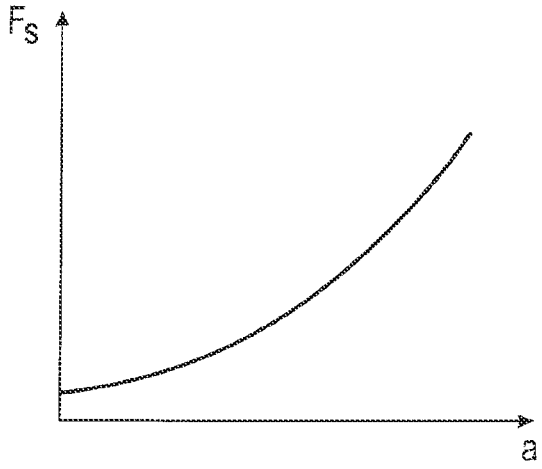
FIG. 3 shows a schematic diagram of the guying force in relation to the existing deviation of the main boom.

Sensors 19 detect the current length L of the telescopic boom 5 and forward the data to the crane controller. The crane controller calculates the required stranding length of the guying LA from the length L according to the following formula:

$$LA=f(L)=Ls+\Delta Ls_{variable},$$

wherein Ls represents the current rope length of the guy stranding 13 and $\Delta Ls_{variable}$ represents a function of the boom length L, which can be both positive and negative. The calculation according to the formula, possibly by taking into account further known geometries of boom and guying via the sensors describe herein, ensures that the Y-guy 10 only introduces a rather minimal, but always sufficient, guying force into the telescopic boom 5. Consequently, the additional load for the telescoping cylinder due to the applied guying force can largely be minimized. On telescoping out, slightly more deviation from the ideal path of the telescopic boom 5 thus can be permitted. Only when the boom moves away from the ideal path in the luffing plane inadmissibly far, is the guying force increased automatically by the controller. The increasing guying force brings the boom 5 back onto the intended path. The force introduced into the boom 5 by the guying thus increases non-linearly with, but still in relation to, the deflection "a" of the telescopic boom 5. A qualitative course is shown in FIG. 3.

When designing the guy winches 11, the winch drives 12 and the telescoping cylinders, the aforementioned additional loads must be taken into account. Further, the respective lengths of each guy stranding may be individually and differentially adjusted by the controller.

To increase the system safety of the telescopic boom 5, corresponding sensor systems 23 are mounted in the region of the guy winches 11 and of the guy stranding 13. The same detect the currently existing rope length of the guy stranding 13 and transmit the measurement data to the crane controller. The same can compare the detected measurement data with the desired nominal length and double-check the same. See 412 of FIG. 4.

The force in the guy stranding 13 generally is kept smaller during the telescoping operation than during the crane work. As such, the controller controls the winch drives 12 to provide a higher tension in the stranding 13 during a first, working condition, and a lower tension in the stranding 13 during a second, telescoping condition by providing different corresponding first and second stranding lengths for a given boom length L.

The invention claimed is:

1. A method for telescoping a main boom including a telescopic boom, which is guyed via a spatial boom guying, the method comprising:

limiting the main boom in its lateral deflection when erected by tensioning the spatial guying during telescoping operation to ensure a sufficient guying force into the telescopic boom.

2. The method according to claim 1, wherein the main boom is guyed during the telescoping operation, and where in a retracted condition the telescopic boom is guyed by the spatial guying, and wherein during the telescoping operation a dimension of the spatial guying is varied synchronously with the telescoping of the boom.

3. The method according to claim 2, wherein the synchronization between the telescoping operation and the variation of the spatial guying is executed by a crane controller.

4. The method according to claim 3, wherein the crane controller detects a current length of the telescopic boom and from the same determines a necessary dimensional change in rope length of the guying.

5. The method according to claim 4, wherein the crane controller actuates a drive of the spatial guying and/or actuates the telescoping drive in dependence on the determined dimensional change.

6. The method according to claim 1, wherein the telescopic guying is slightly pretensioned in a retracted condition and during the telescoping operation a guy length is varied such that with a laterally unloaded boom only small forces act on a push-out mechanism.

7. The method according to claim 1, wherein a deviation of the boom is monitored during the telescoping operation and a guying force introduced into the telescopic boom is adapted, wherein the guying force is non-linearly increased with increasing deviation of the telescopic boom.

8. The method according to claim 7, wherein an actual dimension of the guying is monitored by the crane controller.

9. A crane, comprising:

a telescopable main boom;

a spatial guying; and a crane controller including non-transitory chip medium with instructions which, when executed by a processor, determine a necessary guy dimension of the spatial guying in dependence on a current main boom length during telescoping operation for ensuring a sufficient guying force into the telescopic boom, and adjust an actuator in response to the determined necessary guy dimension.

10. The crane according to claim 9, wherein the actuator adjusts the spatial guying in dependence on the determined guy dimension.

11. The crane according to claim 9, wherein the crane includes a monitor detecting the main boom length, wherein measurement data is transmitted to the crane controller via a bus system and/or a wireless system.

12. The crane according to claim 9, wherein the crane includes a monitor detecting a length of the guy stranding, wherein measurement data is transmitted to the crane controller via a bus system and/or a wireless system.

13. The crane according to claim 9, wherein the spatial guying for the main boom includes two guy supports mounted on a telescopic section of the main boom with one guy winch each; and on a tip of the main boom, deflection pulleys are arranged for a guy rope.

14. The crane according to claim 13, wherein a plurality of winch drives are provided per guy winch.

15. The crane according to claim 14, wherein at least one guy winch includes a mechanical lock.

16. A method for telescoping a boom that is guyed via a spatial boom guying, the method comprising:

controlling lateral deflection of the main boom during telescoping operation by adjusting a length of the spatial guying in response to boom length, while maintaining at least some tension in the spatial guying.

17. The method according to claim 16, wherein the telescoping operation occurs while the boom is positioned at its steepest condition, and wherein the adjusting includes adjusting the length of the spatial guying in response to the boom length, and in response to a lateral deviation of the boom from a luffing plane.

18. The method according to claim 16, wherein a tension force in the spatial guying is increased with respect to increasing lateral deviation.

19. The method of claim 16, wherein the spatial boom guying includes at least two guys forming a Y-shaped guying system, with each of the at least two guys including individual drives that are controlled responsive to a comparison of respective lengths of the at least two guys.

20. The method of claim 16, further comprising monitoring safety of the crane in response to the length of the spatial guying.

* * * * *